US007120972B2

(12) United States Patent
O' Banion

(10) Patent No.: US 7,120,972 B2
(45) Date of Patent: Oct. 17, 2006

(54) MAGNETIC ATTACHMENT DEVICE AND METHODOLOGY

(76) Inventor: David S. O' Banion, 2520 San Remo Dr., Sparks, NV (US) 89434

( * ) Notice: Subject to any disclaimer, the term of this patent is extended or adjusted under 35 U.S.C. 154(b) by 157 days.

(21) Appl. No.: 10/888,740

(22) Filed: Jul. 9, 2004

(65) Prior Publication Data

US 2006/0005361 A1 Jan. 12, 2006

(51) Int. Cl.
*A44B 21/00* (2006.01)

(52) U.S. Cl. ..... 24/303

(58) Field of Classification Search ..... 24/303; 40/600, 621, 661.01, 124.01
See application file for complete search history.

(56) References Cited

U.S. PATENT DOCUMENTS 2,693,654 A * 11/1954 Clark ..... 24/303
5,369,899 A * 12/1994 Reeves ..... 24/303
5,569,103 A * 10/1996 Sihn ..... 473/406
5,682,648 A * 11/1997 Miller ..... 24/5
5,996,116 A * 12/1999 Tate ..... 2/209.13
6,170,088 B1 1/2001 Tate
6,175,963 B1 * 1/2001 Loeffelholz ..... 2/209.13
6,422,955 B1 7/2002 Lopez
6,569,039 B1 * 5/2003 Cope ..... 473/406
6,632,168 B1 * 10/2003 Roberts et al. ..... 63/900
2001/0016526 A1 * 8/2001 Tate ..... 473/406
2004/0117894 A1 * 6/2004 Kuo ..... 2/209.13
2004/0200080 A1 * 10/2004 Lauri ..... 30/541

* cited by examiner

*Primary Examiner*—Robert J. Sandy
(74) *Attorney, Agent, or Firm*—John D. Long

(57) ABSTRACT

At least one embodiment for an apparatus and methodology for reversibly attaching accessory(ies) to a least one article of clothing. The apparatus comprises of at least a magnetically attachment apparatus having at least primary and secondary magnets, which between which is generally reversibly sandwiched at least a portion of an article of clothing. The primary magnet is generally located on the rear of the article of clothing. The secondary magnet is generally located on the front of the article of clothing to reversibly retain at least one accessory, which essentially has at least some component or portion of a component containing ferrous and/or ferromagnetic material. In at least one embodiment, the accessory may be a golf ball marker. In at least one embodiment, the accessory may be jewelry.

20 Claims, 9 Drawing Sheets

MAGNETIC ATTACHMENT DEVICE AND METHODOLOGY

CROSS-REFERENCES TO RELATED APPLICATIONS

Not Applicable.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention generally relates to the field of magnetic attachment clips and in particular, to those magnetic type clips used to attach items to apparels of clothing.

BACKGROUND

Over the millenniums, as humans began to wear clothing, they generally have wanted to make the articles of clothing more attractive, utilitarian or both, by fastening, either permanently or reversibly, various types of accessories to their clothing. One means that could be utilized for this attachment purpose would be the use of magnets. Magnetic attachment means have generally been used by themselves or in conjunction with more traditional attachment means such as pin and clasp.

One such combination attachment means is generally disclosed by U.S. Pat. No. 6,244,955 issued to Lopez. This patent generally shows a magnetic golf ball marker reversibly attaches by magnetic attraction to a ferrous body that is attached reversibly (via pin and clasp) to a portion of a golfing article of clothing such as a brim to a golfing cap. This invention essentially uses a pin and clasp mechanism, which may cause accelerated wear on the fabric by repeated penetration of the fabric by the pin.

Another golf ball marker and holder are generally disclosed by U.S. Pat. No. 6,170,081 as issued to Tate. This patent generally suggests a golf ball marker, a portion of which is made of ferrous material to allow the marker to be reversibly attached to a magnetic base or receptacle, which is incorporated into the structure of an article of clothing such as golfing cap.

These two patents generally show a reversible magnetic means of attachment that has a base, which is essentially either, permanently incorporated or reversibly attached by mechanical means to the article of clothing. Essentially, when a permanently attached base is used, this limits the use of magnetic attachment means to specifically constructed articles of clothing. Further, it may be seen that the additional magnetic type componentry could add to the cost of creating the specially constructed articles of clothing.

When mechanical means are essentially used to attach the base of the magnetic attachment means to non-specifically created articles of clothing, this could possibly lead to accelerated wear and tear of the clothing fabric. For example, during the operation of the device, a pin of the clasp-type attachment mechanism could be used repeatedly, resulting in the repeated puncturing of the fabric of the article of clothing as the base is repeatedly attached to the article of clothing. While a cotton fabric could possibly withstand such repeated puncturing, a finer material such as silk could more noticeably damaged.

What is generally needed therefore is an accessory-to-article of clothing attachment apparatus and methodology, which could use at least one magnetic means to attach itself and an accessory to an article of clothing.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to essentially avoid damage to fabrics caused by penetrating mechanical attachment;

the ability to generally avoid requiring the use of specially constructed articles of clothing;

the ability to essentially remove fully the invention once it has been attached to an article of clothing;

the general ability not to physically mar or penetrate the article of clothing to which the invention is applied; and to generally provide a universal means of attaching accessories to clothing.

These and other advantages may be realized by reference to the remaining portions of the specification, claims, and abstract.

BRIEF DESCRIPTION OF ONE EMBODIMENT OF THE PRESENT INVENTION

One embodiment of the invention may be an apparatus for generally attaching accessories to articles of clothing essentially comprising of a primary magnet, the primary magnet located behind at least a portion of an article of clothing; a secondary magnet, the secondary magnet located in front of the article of clothing, and held in place on the front of an article of clothing by primary magnet; a clothing accessory, at least a portion of which contains a magnetically attracted material, which is magnetically held in place onto at least a portion of the secondary magnet.

Another version of an embodiment of the invention is essentially a process for magnetically attaching accessories to non-magnetic objects generally comprising of the steps of: placing a secondary magnet in front of the non-magnetic object proximate to the position of a primary magnet located behind the non-magnetic object; magnetically holding secondary and primary magnets respectively in place on the non-magnetic object; placing at least one accessory onto at least a portion of the secondary magnet; and magnetically holding the accessory onto at least a portion of the secondary magnet.

Another possible version of an embodiment may be an accessory-to-article of clothing attachment apparatus essentially comprising of a primary magnetic means located behind at least a portion article of clothing; a secondary magnetic means located in front of the clothing, wherein the reciprocal magnetic fields of the primary and secondary magnetic means hold each other in position on the article of clothing; and an accessory means, at least a portion of which is reversibly magnetically affixed to the secondary magnetic means.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. In addition, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
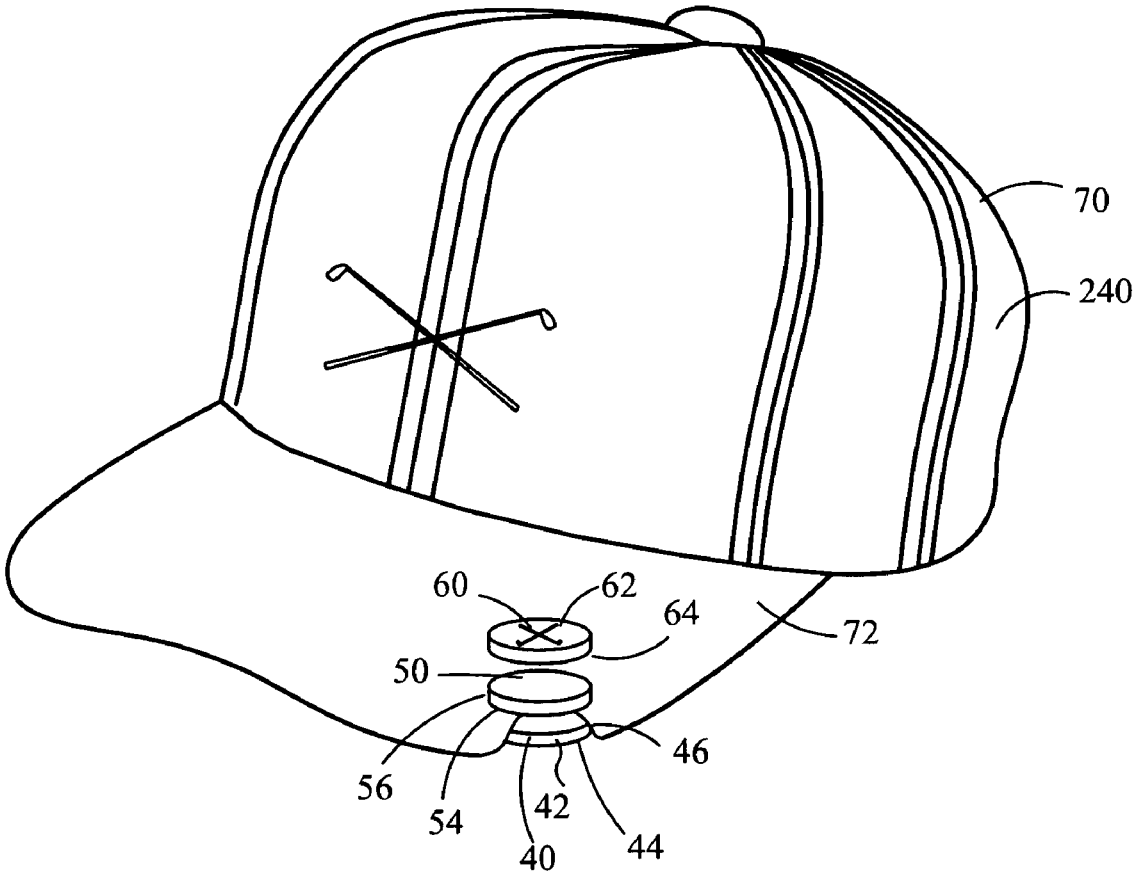
FIG. 1 is substantially a perspective cutaway view of one embodiment of the present invention.

As essentially shown in FIG. 1, the present invention generally comprises a magnetic attachment apparatus, generally indicated by reference numeral 30, and at least one accessory, generally indicated by reference numeral 60 which the magnetic attachment means 60 generally reversibly attaches in at least a desired proximity to at least a portion of an article of clothing 70 made from non-ferrous material. The magnetic attachment apparatus 30 could be generally comprised of a primary magnet, generally indicated by reference numeral 40, and a secondary magnet, generally indicated by reference numeral 50. The primary magnet 40 could generally have a front 42, a back 44, and one or more sides 46. Similarly, the secondary magnet 50 will have generally a front 52, a back 54 and one or more sides 56. The accessory 60 could have generally a front 62 and a back 64.

Figure 2:
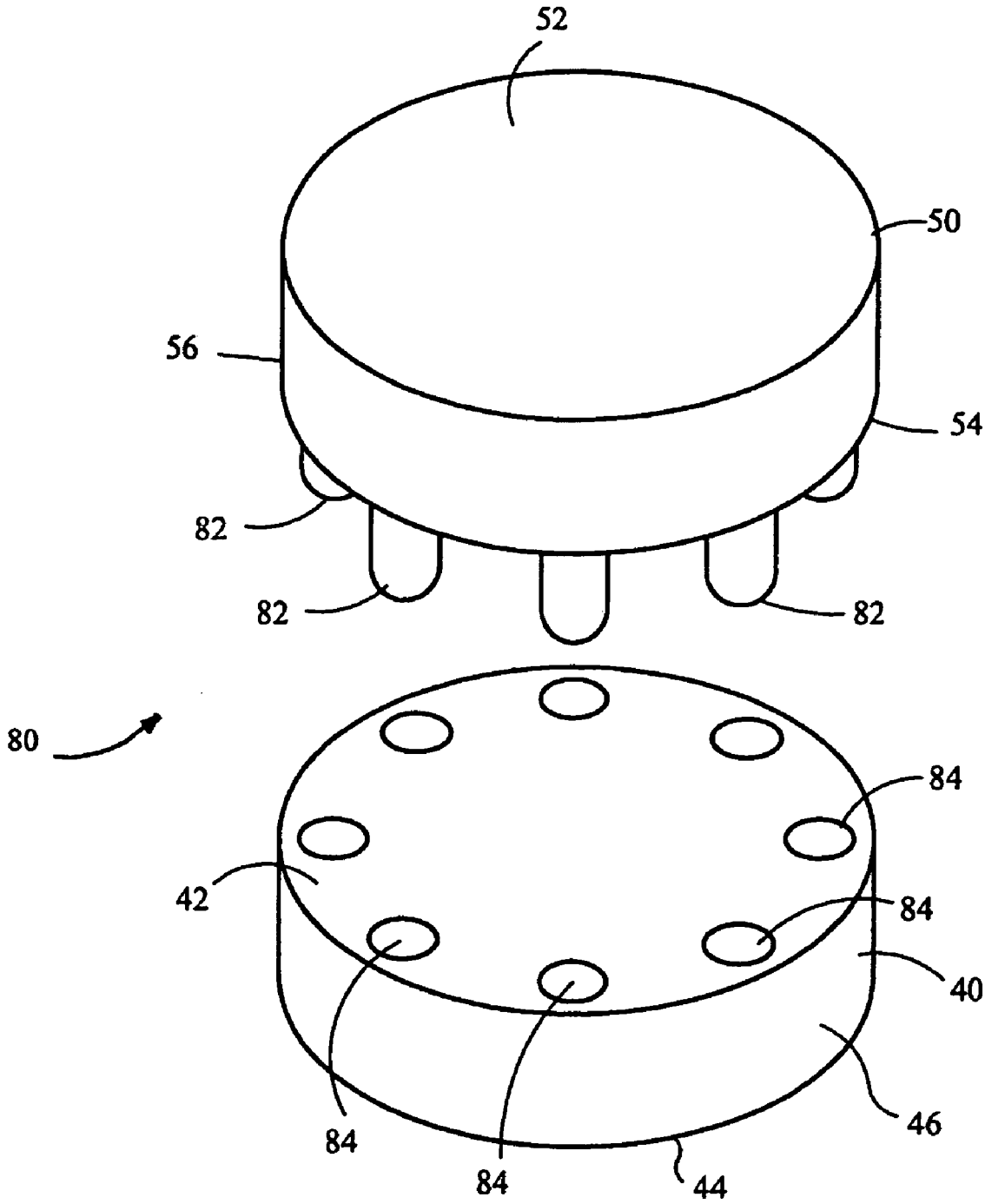
FIG. 2 is substantially a perspective cutaway view of one embodiment of the magnetic attachment apparatus of the present invention.

In at least one embodiment as generally shown in FIG. 2, the front 42 of the primary magnet 40 and the back 54 of the secondary magnet 50 could feature anti-movement devices 80 that interact with the fabric of the article of clothing 70 to prevent or otherwise lessen any unwanted movement of the primary and secondary magnets 40, 50 from their placement or orientation by the user on the article of clothing 70. In one embodiment, the anti-movement device 80 could comprise of at least a one or more protrusions 82 emanating from the surface of the back 54 of the secondary magnet 50 and from the surface the front 42 of the primary magnet 40 that engage the surface of the fabric.

Another embodiment could find the anti-movement device(s) 80 located on both (or either) the back 54 and the front 42. There is at least one version of this embodiment where the anti-movement device 80 comprises at least one protrusion 82 on one surface that matches at least one reciprocal depression 84 on the other surface. In this manner, various combinations of matching protrusions 82 and depressions 84 could be used in the invention to provide generally a stronger fixation of that portion of fabric 73 between the back 52 and front 42 of the secondary and primary magnets 50, 40, respectively. Other embodiments could employ, on at least portions of the surfaces of back 42 and front 52, other various friction-based securing means known to the art to generally limit the movement of magnetic attachment apparatus 30 on the article of clothing 70.

The accessory 60 could be selected from a wide variety of items that a user could be interested in reversibly attaching to an article of clothing 70. The accessory 60 could essentially have at least a portion of its composition or one or more of its possible components made from ferrous material 68 to be able to interact properly with the magnetic field of the secondary magnet 50 for generally reversible retention of the accessory 60 by the magnetic attachment accessory 30. In at least one embodiment, at least a portion of the ferrous material is ferromagnetic. The accessory 60, in at least one embodiment, might be further configured so that at least a portion of its surface may reciprocally fit onto or into at least a corresponding portion of the front base 52 of the secondary magnet 50.

In at least one embodiment of the invention, one or more of the accessories 60, primary magnet 40, secondary magnet 40, individually or various combinations thereof, as known in the art, could incorporate one or more separator mechanisms 100. The separator mechanism 100 could use one or more various mechanical apparatuses or electrical/electronic apparatuses, or both, to interfere, negate, weaken, or otherwise control one or more of the magnetic fields created by one or more of the components of the invention. In this manner, the user could utilize the separator mechanism(s) 100 to help place, remove or both, the accessory 60 from the secondary magnet 50. The separator mechanism 100 could also be used to generally place, adjust, and remove the secondary magnet 50 and primary magnet 40 from an article of clothing or one another. As the inventor can personally attest, depending on the magnetic strength built into the specific embodiments of the primary and secondary magnets 40, 50, once the two magnets are manually moved proximately to their respective sphere of magnetic influence, getting one's fingers pinched between two or more such attracted magnets is a strong possibility with possibly painful results.

Figure 3:
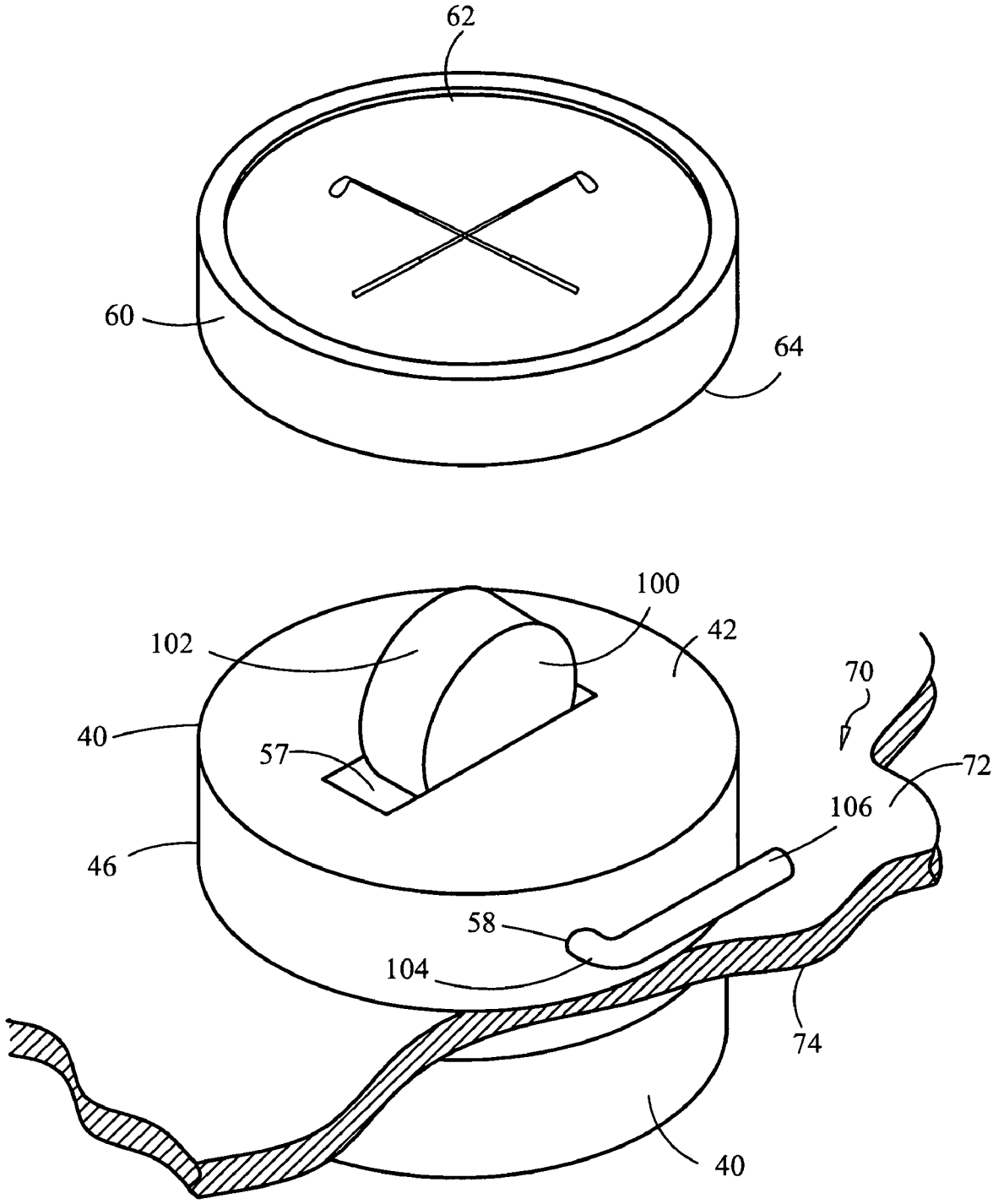
FIG. 3 is substantially a perspective cutaway view of one embodiment of the present invention.

As substantially shown in FIG. 3, at least one embodiment could have at least one separator mechanism 100 be a component of the secondary magnet 50. In such an embodiment, the separator mechanism 100 could then comprise a cam 102 attached to one end of an axle 104 which is connected at the other end to an activator 106. The cam 102 could lie in a slot 57 that cuts through the middle of the secondary magnet 50 to generally connect the front 52 and back 54 of the secondary magnet 50. The cam 102 would have orientation that could generally transverse the plane of the front 52 and back 54 of the secondary magnet 50 during operation of the separator mechanism 100. The axle 104 can generally be moveably located in a shaft 58 essentially cut into the secondary magnet 50 that generally connects the slot 57 with a side 56. The axle 104 can generally be moveably located in a shaft 58 essentially cut into the secondary magnet 50 that generally connects the slot 57 with a side 56. The axle 104 can generally extend out the side 56 to essentially present the activator 106 as being proximate to a side 56 of the secondary magnet. The activator 106 could be any suitable turning device such as a crown, lever, or the like.

When the separator mechanism 100 is not being used, at least a significant portion of the cam 102 essentially resides in the slot 57. When the user generally moves the activator 106 to rotate the axle 104 and cam 102, a significant portion of the cam 102 could essentially rise out of the slot 57. If the activator 106 has at least partial rotation in one direction, a significant portion of cam 102 could appear on the front 52. Corresponding rotation of the activator 106 in the opposite direction could bring the significant portion of the cam 102 proximate to the back 54 of the secondary magnet 50.

In this means of operation, one direction of partial rotation could bring the significant portion of the cam 102 towards the back 54 and into contact with front 42 of a proximate primary magnet 40. The user could thus use separator mechanism 100 to generally control the bringing together or separating of the primary and secondary magnets 40, 50.

In a similar manner, the user could use the separator mechanism 100 to control generally the bringing together or separating of the secondary magnet 50 and the accessory (ies) 60. In this embodiment, the cam 102 could be essentially rotated to meet the back 64 of the accessory(ies) 60.

Figure 4:
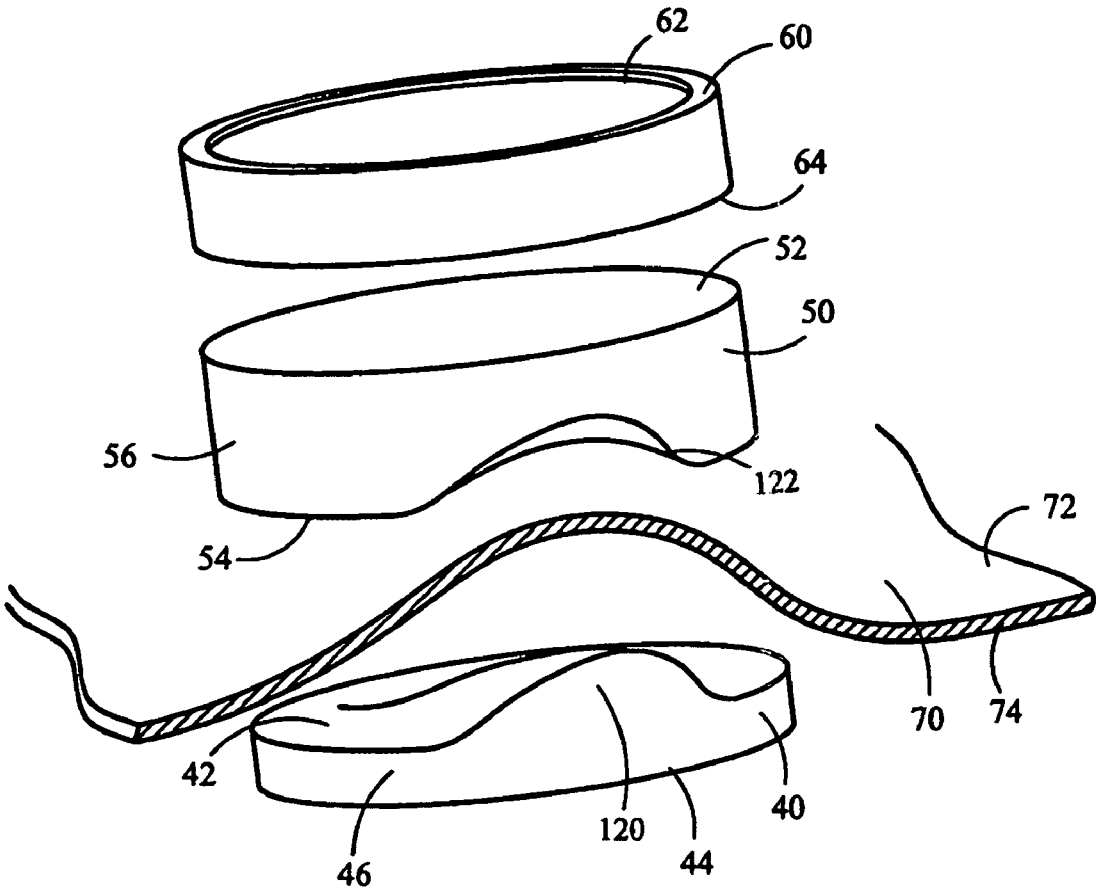
FIG. 4 is substantially a perspective cutaway view of one embodiment of the present invention.

As substantially shown in FIG. 4, another embodiment of the separator mechanism 100 could be an accessory 60, secondary magnet 50 or primary magnet 40/secondary magnet 50 or both sets of combinations having at least projection 120 and at least one corresponding recession 122 on their interacting or mating surfaces. For example, when the back 64 of at least one accessory 60 is in proper connection and alignment with the front 52 of the secondary magnet 50, at least one projection 120 of the back 72 of the accessory 60 is reversibly received in at least one recession 122 of the front 52 of the secondary magnet 50. In at least one embodiment, significant portion of projection 120 and recession 122 will lay along the respective sides of the primary magnet 40, secondary magnet 50, accessory(ies) 60 from which they emanate. The user, by rotating both the accessory 60 and the secondary magnet 50 in the opposite directions, will cause the projection 120 to ride out of the recession 122. As the projection 120 begins to rest on a non-recession portion of the front 52 of the secondary magnet 50, this initiates at least a partial separation of the surfaces of the back 64 of the accessory 60 and the front 52 of the secondary magnet 50. This mechanical separation helps to effect at least a partial withdrawal of the respective components of the invention (e.g., secondary magnet 50 and the accessory 60) from the respective spheres of each other's magnetic influence. This allows the user to generally remove the accessory 60 from the secondary magnet 50 with greater ease than when both components are fully mated and are generally under a greater magnetic influence.

Other embodiments of this type of separator mechanism(s) 100 may be used with primary magnet 40 and secondary magnet 50. In this combination, as well as the accessory(ies) 60/secondary magnet combination, the separator mechanism 100 could be comprised of a wide variety of projections 120 and recessions 122 differing in size, placement number and the like. The separation mechanism 100 could be arranged in a wide variety of versions using the skill known or will be known in the art to generally affect assistance in handling the effect of the magnetic influence of the various components of invention when essentially adjusting the physical placement of the components in relation to one another.

The portion of the article of clothing 70 to which the primary magnet 40, and secondary magnet 50 will be placed in contact generally has two sides, a front 74 and a back 76. The article of clothing 70 generally should be made from non-ferrous or non-magnetic material to help avoid unwanted interruption with the magnetic attraction essentially generated by the primary magnet 40, secondary magnet 50, accessory (ies) 60, and the like.

Figure 5:
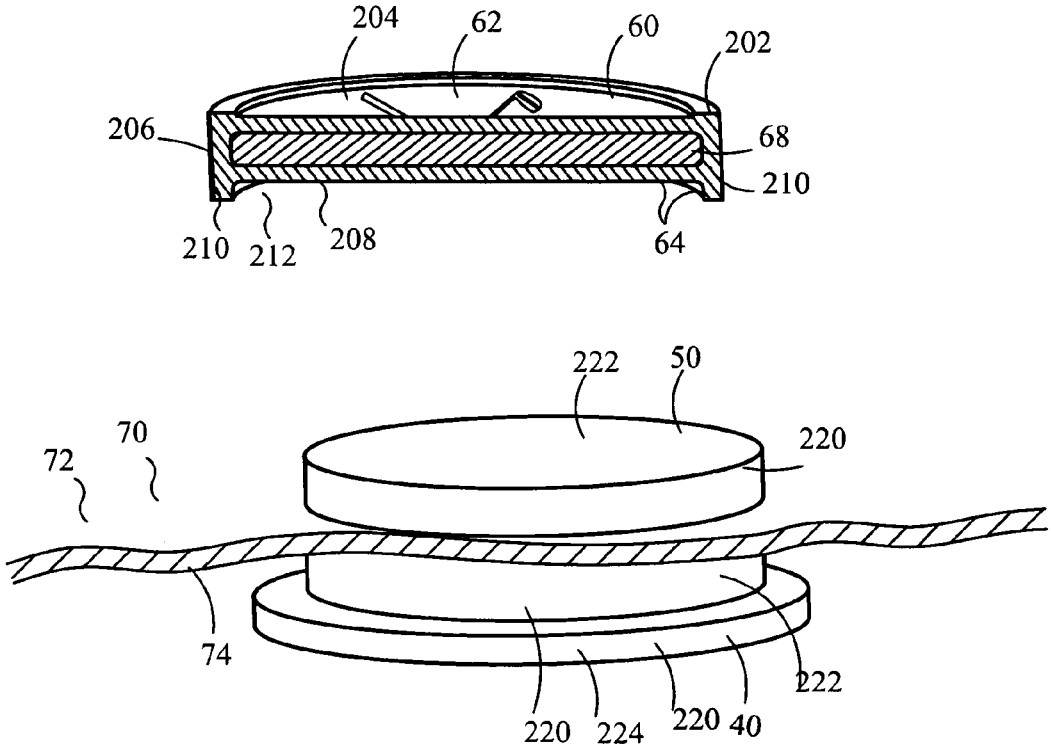
FIG. 5 is substantially a perspective view of an embodiment of the present invention.

As essentially shown in FIG. 5, one possible embodiment of the invention could utilize a golf ball marker 200, as an accessory 60; golf clothing 240, such as a golfing cap, as the article of clothing 70; and a magnetic attachment apparatus 30.

Figure 7:
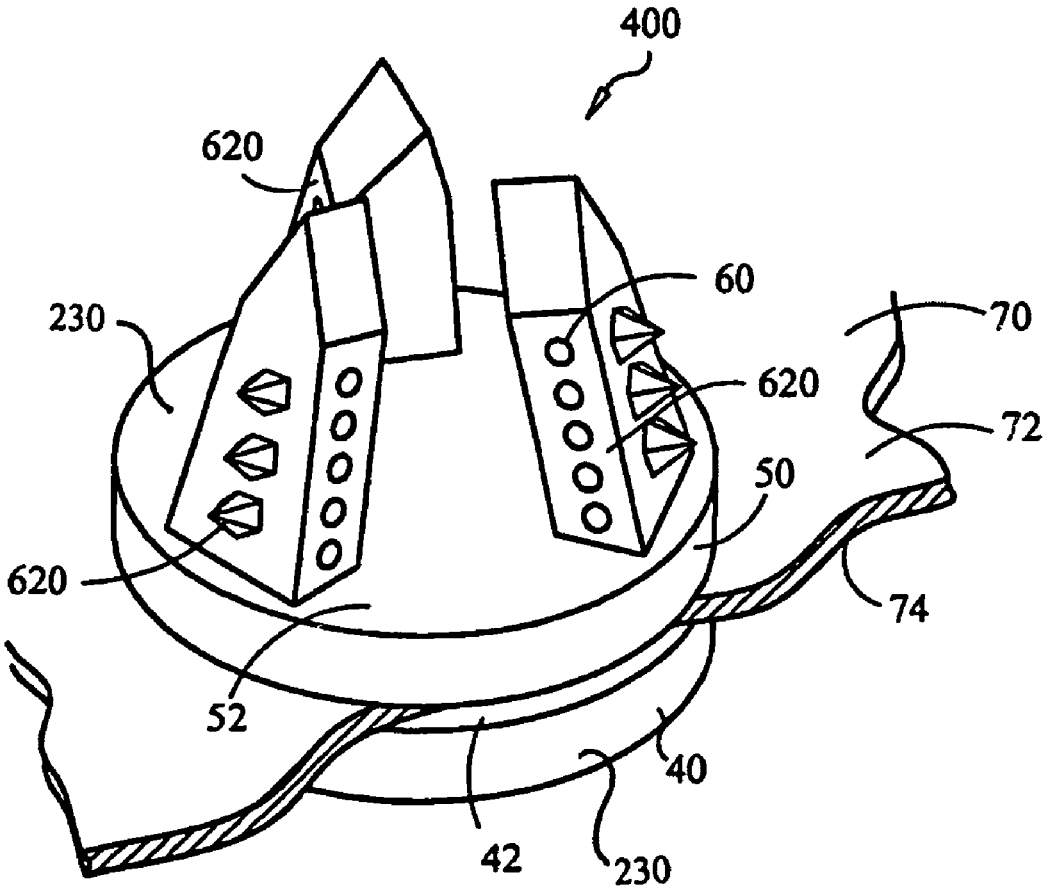
FIG. 7 is substantially a perspective cutaway view of one version of the jewelry embodiment of the present invention.

The magnetic attachment apparatus 30 in the presently described embodiment could be composed of a primary magnet 40 and a secondary magnet 50. The primary magnet 40 could be comprised, of a plurality of disc-shaped composing magnets 220 stacked together. In one version of this embodiment, the composition magnets 220 could be enclosed in a case 230 (as shown in FIG. 7). The stacking generally allows the individual magnetic force of the individual composition magnets 220 to be easily accumulated to a desired strength. In this manner, the magnetic strength of the primary magnet 40 for the present embodiment essentially can be adjusted through stacking so that the primary magnet 40 will be generally strong enough to securely and reversibly attract and hold the secondary magnet 50 in place on the article of clothing 70 without seriously impairing or otherwise overpowering the secondary magnet's 50 general ability to reversibly retain one or more accessories 60.

In the present embodiment, the composing magnets 220, which essentially make up at least a portion of the primary and secondary magnets, 40, 50, would have at least two different diameter sizes. In the present embodiment, the primary magnet 40 is generally comprised of at least one smaller diameter composing magnet 222, which is placed on top of a single larger diameter composing magnet 224 or a stack of larger diameter composing magnets 224. The smaller diameter composing magnet 222 is essentially laid flat upon and centralized within the diameter of the top surface of the larger diameter composing magnet 224 or stack of larger diameter composing diameter magnets 224.

The composing magnets 220 are generally fixed magnetic metal magnets of the N/M type obtained from Universal (Ningbo) Mangtech Co., Ltd, 99 Bai Ning Street, Jaingong Ningbo, China, Tel: 0086-574-87833814 distributed by K & D Magnets, Inc., 561-392-2103. The smaller diameter composing magnet 222 has a 19.0 mm diameter with 0.5 mm thickness. The larger diameter composing magnet 224 has a 24.0 mm diameter with 0.5 mm thickness.

In other embodiments, it is foreseen that the composing magnets 220 could be electromagnetic. In this manner, electronic circuitry combined essentially with miniaturized power sources, as known to those skilled in the art could provide the controllable magnetic power for the magnetic attachment apparatus 30. This could possibly afford the user an ability to adjust the magnetic forces of the various magnetic components of the invention to suit a particular embodiment's needs. Additionally, if the primary, secondary magnets, 40, 50, use electromagnets, then appropriate miniaturized electronic circuitry as known to those skilled in the art could be adapted to provide a separator mechanism 100.

If cases 230 are desired, for example for the partial or full encapsulation for the primary, secondary magnets 40, 50, then the case(s) 230 could be constructed in a variety of shapes, sizes, designs, and materials. The case 230 construction could be configured to generally meet imposed aesthetical or utility requirements of a particular embodiment. Further, in at least one embodiment, the case 230 essentially helps a plurality of combined composing magnets 220, which are not otherwise physically attached to one another, maintain their desired orientation and combined shape. The case 230 could be constructed of non-magnetic material (e.g., plastic) in such dimensions so as not to interfere significantly with the magnetic force generated by the composing magnet(s) 220 as used by the primary magnet 40, secondary magnet 50. In other applications, at least a part of the case 230 could be constructed of ferromagnetic materials in a manner known to those skilled in the art to essentially complement the magnetic force generated by the composing magnet(s) 220.

In other embodiments of the invention, a combination of composing magnets 220 or a single composing magnet 220 specifically constructed or selected utilizing the knowledge of those skilled in the art, to have a desired size, shape, and magnetic power could comprise the primary magnet 40. The primary magnet 40 and/or secondary magnet 50 in these other embodiments could also be constructed without being encapsulated in a case 230. The number, type, size, shape and magnetic strength of the composing magnet(s) 220 used in the invention could be selected using the knowledge of those skilled in the appropriate art to meet the requirements and needs of a particular embodiment of the invention.

In the present golf ball marker embodiment, the secondary magnet 50 would utilize a small diameter composing magnet 222. Alternate embodiments of the invention could place the composing magnet(s) 220 of the secondary magnet 50 into a case 230 similar to the one that could be used by the primary magnet 40.

The golf ball marker 200, an accessory 60, has a body 202 with a front 204, sides 206 and back 208. In at least one embodiment, the body 202 is disc-shaped. The front 204 could bear designs, colorations, pictures, shapes, indicia, textures, and the like to form an attractive presentation.

The back 208 in at least one embodiment could have a raised rim 210 projecting outward along the edge of the back 208 to generally form an open cavity 212 of essentially sufficient dimensions to receive at least a portion of the front 52 of the secondary magnet 50. In this manner, when the golf ball marker 200 is generally reversibly retained by the secondary magnet secondary magnet 50, at least a portion of cavity 212 of the golf ball marker 200 cups at least a portion of the front 52 of the secondary magnet 50. It could be seen that physical contact caused by the "cupping" action could aid in the retention of the accessory 60 by magnetic attachment apparatus 30 by essentially resisting any shearing force that might generally cross the lengthwise or longitudinal axis of the applied invention. For example, if the wearer of the golf cap 240, to which the invention was applied, would quickly turn her head during a golf swing, thus moving the golf cap 240, this rotating motion could generally impart a traversing force to the applied invention, which could possibly dislodge the accessory(ies) 60 from the magnetic attachment apparatus 30.

The body 202 of the golf ball marker 200 in at least one embodiment is made of non-ferrous material such as fourteen carat gold or plastic. As stated earlier, the body 202 encapsulates at least a portion of ferrous material 68, which in at least one embodiment can be ferromagnetic, to foster the reversible magnetic retention of the golf ball marker 200 by the secondary magnet 50

Figure 6:
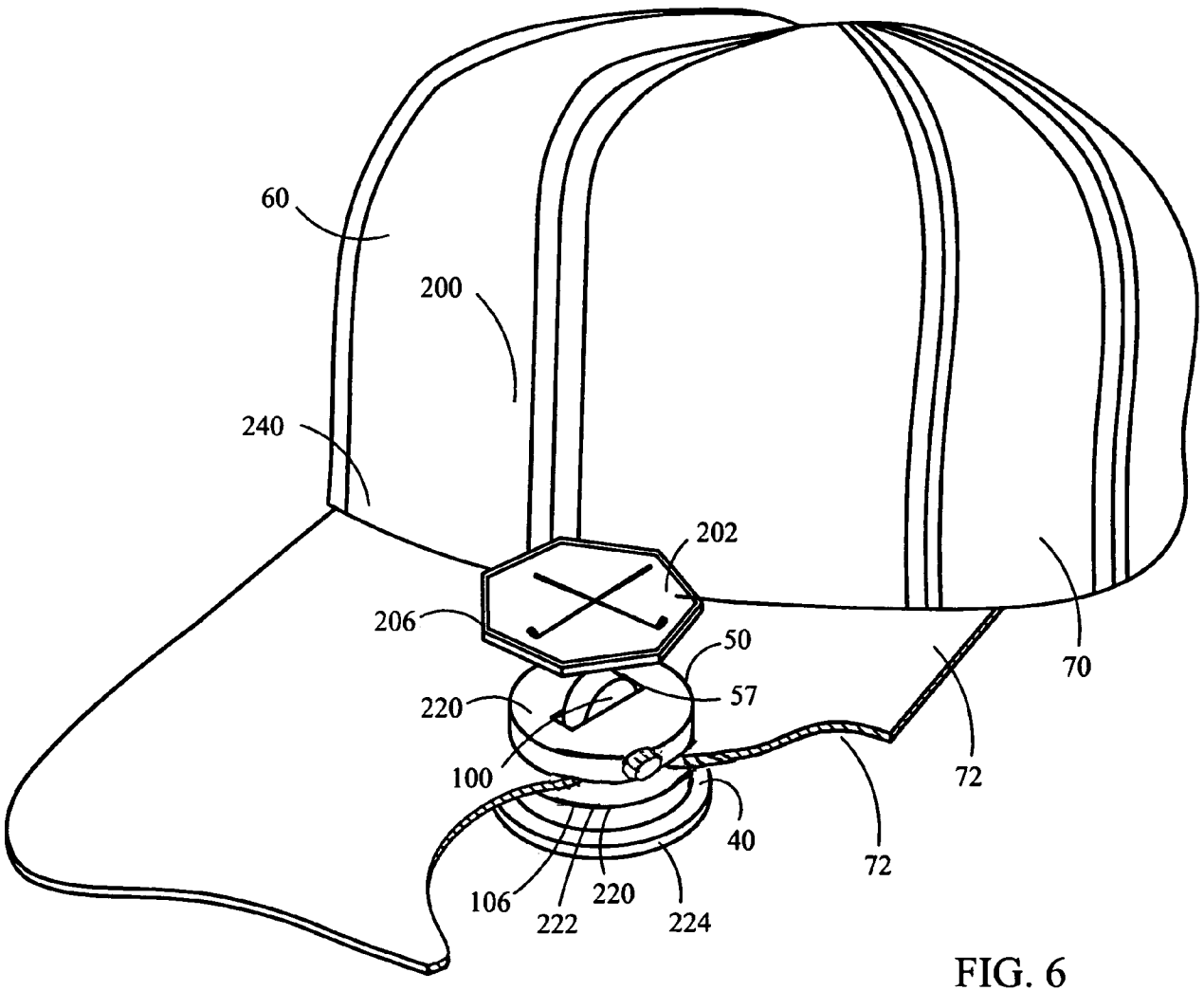
FIG. 6 is substantially a perspective cutaway view of one version of the golf ball marker embodiment of the present invention.

As essentially shown in FIG. 6, the golf ball marker embodiment could also employ a separator mechanism 100 with the secondary magnet 50. Other versions (not shown) of embodiment could also provide a separator mechanism 100 for the primary magnet 40, accessory 60, the secondary magnet 50, together, separately, or various combinations thereof.

As generally shown in FIG. 7, another embodiment of the invention could have accessories 60, which are jewelry, as generally indicated by reference numeral 400. In this embodiment, it is possible for at least one version that essentially reversibly retains several accessories 60 simultaneously. These accessories 60 could be essentially combined to be generally held together and attached to the secondary magnet 50. In this manner, the user could generally select certain compatible accessories 60 or accessory components 620 from a set of accessories 60 or set of accessory components 620. The user could generally arrange the selected accessories 60 or selected accessories components 620. The user could essentially place the arranged selection on at least a portion of the secondary magnet 50 of a magnetic attachment apparatus 30 previously placed on the selected article of clothing 70.

Figure 8:
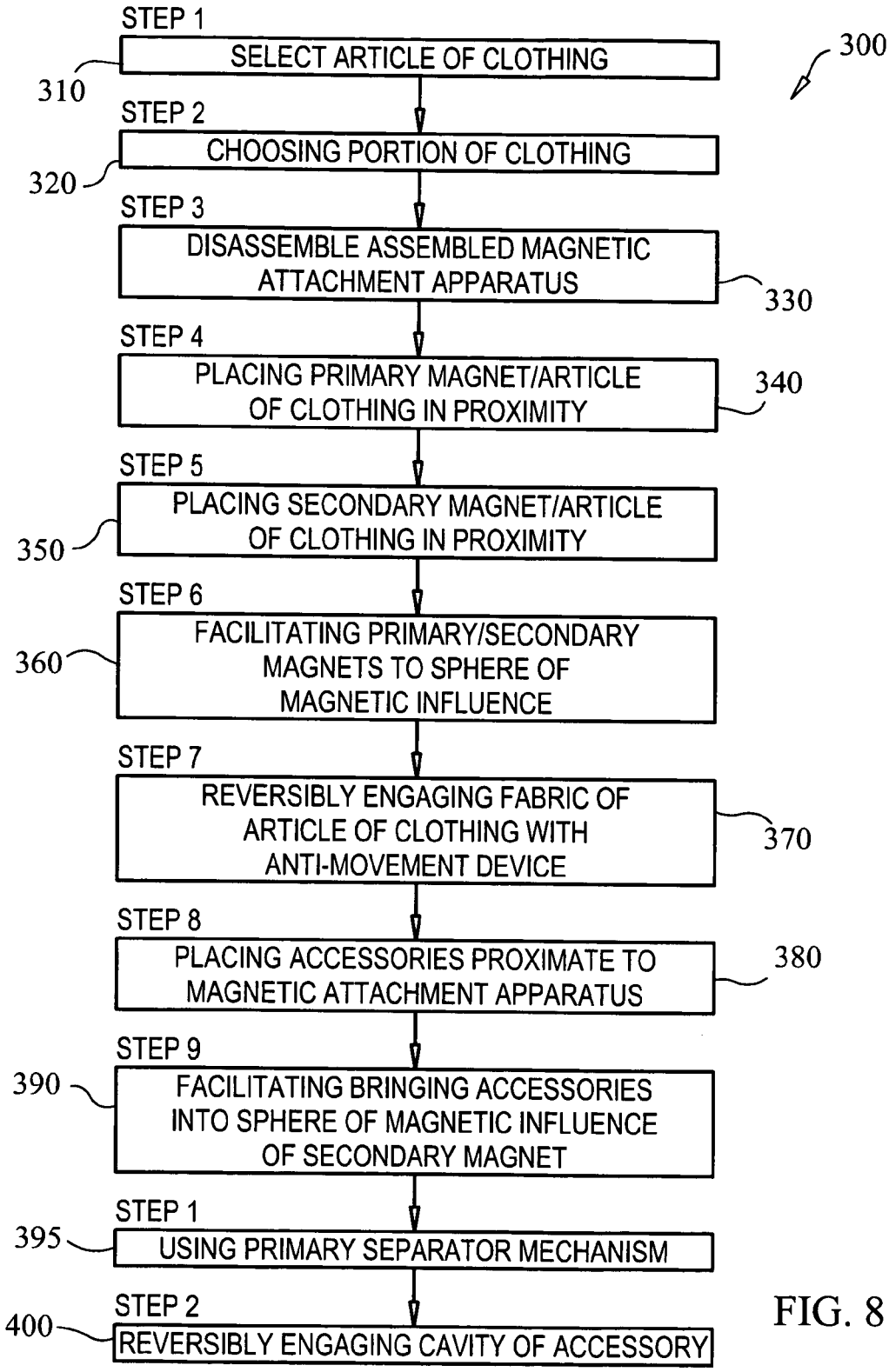
FIG. 8 is substantially a flow chart for one embodiment of an operation of the present invention.

FIG. 8 generally show a flow chart, generally indicated by reference numeral 300, which diagrams one embodiment for an operation of the invention. The following order of steps is but one version of operation and does not limit the invention. Other embodiments may have more, less, or the same steps in a same or different orders.

Step one 310 is generally selecting at least one article of clothing 70 on which the accessory(ies) 60/accessory components (not shown) would be reversibly placed.

Step two 320 is generally choosing of that portion (the chosen portion) of selected article clothing 70 to which the 60 accessory(ies) 60/accessory components 620 would be placed upon.

Step three 330 is generally disassembling of an assembled magnetic attachment apparatus 30.

Step four 340 is essentially placing a front 42 of the primary magnet 40 with a back 76 of the article of clothing 70 in proximity to the chosen portion.

Step five 350 is generally placing a back 54 of the secondary magnet 40 with a front 74 of the article of clothing 70 in proximity to the chosen portion.

Step six 360 is essentially facilitating of the bringing of the primary and secondary magnets 40, 50 into the general sphere of magnetic influence of their respective magnetic fields via a supplemental separation mechanism 100.

Step seven 370 is generally reversibly engaging of the fabric of the article of clothing 70 with at least one anti-movement device essentially located on the magnet attachment apparatus.

Step eight 380 is essentially placing of selected accessory (ies) 60, selected accessory components 620 proximate to at least a portion of the magnetic attachment apparatus 30.

Step nine 390 is generally facilitating the bringing of the selected accessory(ies) 60, selected accessory component 620 generally into the sphere of magnetic influence of the secondary magnet 50.

Step nine A 395 is essentially using a primary separator mechanism 100 to generally facilitate the bringing of the selected accessory(ies) 60, selected accessory components 620 into the sphere of magnetic influence of the secondary magnet 50.

Step ten 400 is generally reversibly engaging a cavity of the selected accessory(ies) 60, selected accessory component(s) with at least a portion of the secondary magnet 50.

Step eleven 410 is essentially reversibly attaching at least a portion of the selected accessory(ies) 60, selected accessory components 620 to at least a portion of the magnetic attachment apparatus 30

Figure 9:
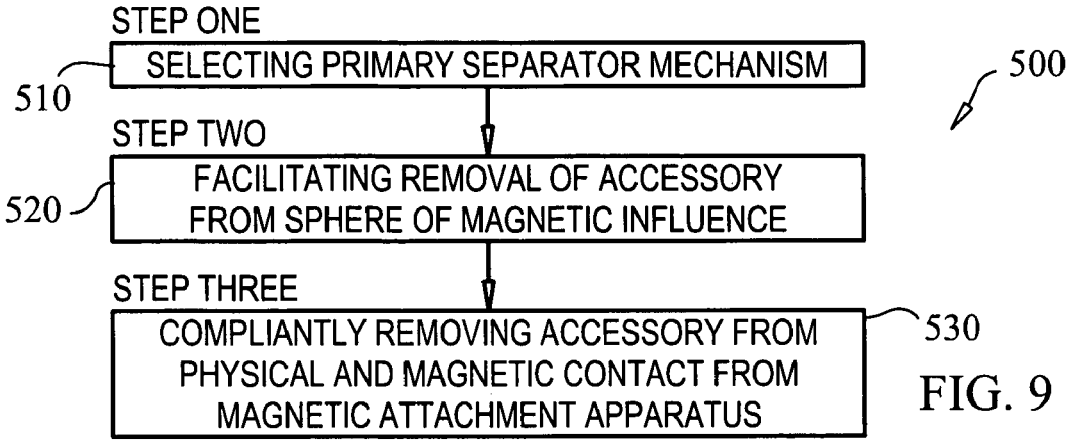
FIG. 9 is substantially a flow chart for one embodiment of an operation of the present invention.

As generally shown in FIG. 9, the one embodiment for the protocol, generally referenced by reference numeral 500, to essentially bring at least one selected accessory(ies) 60, selected accessory components 620 away from a magnetic attachment apparatus 30 starts with step one 510. Step one 510 is generally selecting a primary separator mechanism 100 to facilitate the removal of at least one selected accessory(ies) 60, selected accessory components 620. Step two 520 is generally facilitating the bringing of the selected accessory(ies) 60, selected accessory components 620 out of the sphere of magnetic influence of the secondary magnet 50 through the use of the selected primary separator mechanism 100. Step three is essentially removing the selected accessory(ies) 60, selected accessory components 620 from physical and magnetic contact from the magnetic attachment apparatus 30.

Figure 10:
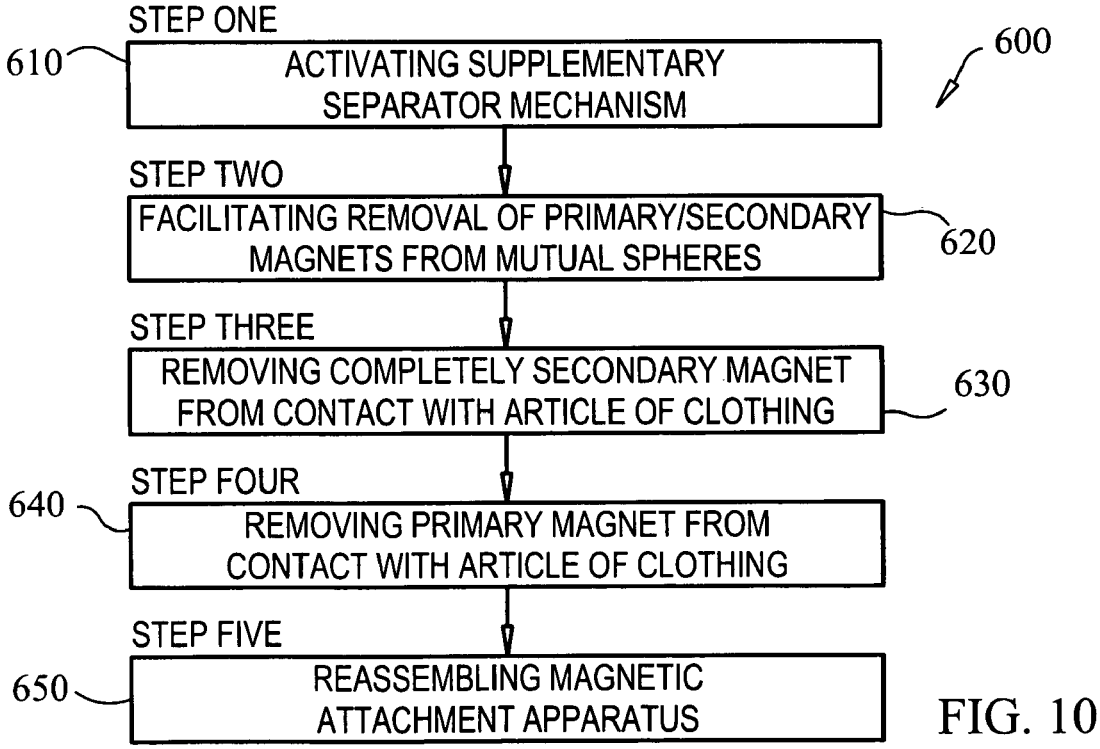
FIG. 10 is substantially a flow chart for one embodiment of an operation of the present invention.

As generally shown in FIG. 10, one embodiment for the removal of the magnetic attachment apparatus 30 from the article of clothing 70 protocol, generally indicated by reference numeral 600, is essentially based on having one or more accessories 60 or one or more accessory components 620 previously removed from the magnetic attachment apparatus 30. Step one 610 is activating a supplementary separator mechanism 100 to essentially facilitate the removal of primary, secondary magnets 40, 50 out of the sphere of magnetic influence of the secondary magnet 50. Step two 620 is generally facilitating the removal of the primary, secondary magnets 40, 50 out of the mutual spheres of mutual magnetic influence through the use of the selected supplemental separator mechanism 100. Step three 630 is essentially removing the secondary magnet 50 from contact with the article of clothing 70 and the magnetic influence of the primary magnet 40. Step four 640 is generally removing the primary magnet 40 from contact the article of clothing 70. Step five is essentially reassembling the magnetic attachment apparatus for storage.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

I claim:

1. An apparatus for attaching accessories to articles of clothing comprising:

(A) a primary magnet, the primary magnet located behind at least a portion of an article of clothing;

(B) a secondary magnet, the secondary magnet located in front of the article of clothing, and held in place on the front of article of clothing by the primary magnet;

(C) a clothing accessory, at least a portion of which contains a magnetically attracted material, which is magnetically held in place onto at least a portion of the secondary magnet;

wherein the magnetic force for the primary magnet is greater than the magnetic force for the secondary magnet both when the secondary magnet is not associated with the clothing accessory and when the secondary magnet is associated with the clothing accessory.

2. An apparatus for attaching accessories of claim 1 wherein the magnetically attracted material is ferrous-based material.

3. An apparatus for attaching accessories of claim 1 wherein the ferrous-based material is magnetic.

4. An apparatus for attaching accessories of claim 1 wherein the clothing accessory is a golf ball marker.

5. An apparatus for attaching accessories of claim 1 wherein the clothing accessory is jewelry.

6. An apparatus for attaching accessories of claim 1 further comprising of an anti-movement device.

7. An apparatus for attaching accessories of claim 1 further comprises a primary separator mechanism to assist the removal of the accessory from the secondary magnet.

8. An apparatus for attaching accessories of claim 1 further comprises a secondary separator mechanism to remove the primary magnet and secondary magnet from the spheres of mutual magnetic influence.

9. A process for magnetically attaching accessories to non-magnetic objects, comprising the steps of:

(A) providing a primary magnet and a secondary magnet, the magnetic force for the primary magnet being greater than the magnetic force for the secondary magnet whether or not the secondary magnetic is associated with the clothing accessory;

(B) placing a secondary magnet in front of the non-magnetic object proximate to the position of a primary magnet located behind the non-magnetic object;

(C) magnetically holding secondary and primary magnets respectively in place on the non-magnetic object;

(D) placing at least one accessory onto at least a portion of the secondary magnet; and (E) magnetically holding the accessory onto at least a portion of the secondary magnet.

10. A process for magnetically attaching accessories of claim 9 wherein both of the steps of magnetically holding and placing of the accessory are reversible.

11. A process for magnetically attaching accessories of claim 9 wherein at least portion of the accessory is made from ferrous material.

12. A process for magnetically attaching accessories of claim 9 wherein both of the steps of magnetically holding and placing of the secondary magnet are reversible.

13. A process for magnetically attaching accessories of claim 9 further comprises the step of removing the accessory from the secondary magnet.

14. A process for magnetically attaching accessories of claim 13 further comprises providing a primary separator mechanism to remove the accessory from the secondary magnet.

15. A process for magnetically attaching accessories of claim 9 further comprises the step of providing a supplemental separator mechanism to remove the secondary magnet and the primary magnet from the proximate influence of their respective magnetic fields.

16. A process for magnetically attaching accessories of claim 15 further comprising of the step of rotating the primary magnet relative to the secondary magnet to remove a protrusion from a depression to accomplish the removal.

17. An accessory-to-article of clothing attachment apparatus comprising:

(A) a primary magnetic means for attracting a secondary magnetic means;

(B) a secondary magnetic means for attracting a primary magnetic means and for attracting an accessory means;

(C) an accessory means for accessorizing an article of clothing;

wherein the magnetic force for the primary magnetic means is greater than the magnetic force for the secondary magnetic means both when the secondary magnetic means is not associated with the accessory means and when the secondary magnet is associated with the accessory means.

18. An accessory-to-article of clothing attachment apparatus of claim 17 further comprising a separator means for removing the primary magnetic means from the secondary magnetic means.

19. An accessory-to-article of clothing attachment apparatus of claim 17 further comprising a separator means for releasing the accessory means from the secondary magnetic means.

20. An accessory-to-article of clothing attachment apparatus of claim 19, wherein the separator means is further comprised of a recession means for receiving a protrusion means.

* * * * *